US005333236A

United States Patent [19]

Bahl et al.

[11] Patent Number: 5,333,236

[45] Date of Patent: Jul. 26, 1994

[54] SPEECH RECOGNIZER HAVING A SPEECH CODER FOR AN ACOUSTIC MATCH BASED ON CONTEXT-DEPENDENT SPEECH-TRANSITION ACOUSTIC MODELS

[75] Inventors: Lalit R. Bahl, Amawalk, N.Y.; Peter V. De Souza, San Jose, Calif.; Ponani S. Gopalakrishnan, Croton-on-Hudson; Michael A. Picheny, White Plains, both of N.Y.

[73] Assignee: International Business Machines Corporation, Armonk, N.Y.

[21] Appl. No.: 942,862

[22] Filed: Sep. 10, 1992

[51] Int. Cl.[5] ..... G10L 9/00

[52] U.S. Cl. ..... 395/2.65

[58] Field of Search ..... 381/41-47; 395/2.65, 2.64, 2.66

[56] References Cited

U.S. PATENT DOCUMENTS

| | | | |
|---|---|---|---|
| 4,759,068 | 7/1988 | Bahl et al. | 381/43 |
| 4,783,804 | 11/1988 | Juang et al. | 395/2 |
| 4,977,599 | 12/1990 | Bahl et al. | 381/41 |
| 4,980,918 | 12/1990 | Bahl et al. | 381/43 |
| 5,031,217 | 7/1991 | Nishimura | 381/43 |

OTHER PUBLICATIONS

Bahl, L. R., et al. "Vector Quantization Procedure For Speech Recognition Systems Using Discrete Parameter Phoneme-Based Markov Word Models," *IBM Technical Disclosure Bulletin,* vol. 32, No. 7, Dec. 1989, pp. 320 and 321.

F. Jelinek, "Continuous Speech Recognition by Statistical Methods," *Proceedings of the IEEE,* vol. 64, No. 4, Apr. 1976, pp. 532-536.

*Primary Examiner*—Michael R. Fleming
*Assistant Examiner*—Michelle Doerrler
*Attorney, Agent, or Firm*—Marc D. Schechter; Robert P. Tassinari

[57] ABSTRACT

A speech coding apparatus compares the closeness of the feature value of a feature vector signal of an utterance to the parameter values of prototype vector signals to obtain prototype match scores for the feature vector signal and each prototype vector signal. The speech coding apparatus stores a plurality of speech transition models representing speech transitions. At least one speech transition is represented by a plurality of different models. Each speech transition model has a plurality of model outputs, each comprising a prototype match score for a prototype vector signal. Each model output has an output probability. A model match score for a first feature vector signal and each speech transition model comprises the output probability for at least one prototype match score for the first feature vector signal and a prototype vector signal. A speech transition match score for the first feature vector signal and each speech transition comprises the best model match score for the first feature vector signal and all speech transition models representing the speech transition. The identification value of each speech transition and the speech transition match score for the first feature vector signal and each speech transition are output as a coded utterance representation signal of the first feature vector signal.

31 Claims, 6 Drawing Sheets

SPEECH RECOGNIZER HAVING A SPEECH CODER FOR AN ACOUSTIC MATCH BASED ON CONTEXT-DEPENDENT SPEECH-TRANSITION ACOUSTIC MODELS

BACKGROUND OF THE INVENTION

The invention relates to speech coding devices and methods, such as for speech recognition systems.

In speech recognition systems, it is known to model utterances of words, phonemes, and parts of phonemes using context-independent or context-dependent acoustic models. Context-dependent acoustic models simulate utterances of words or portions of words in dependence on the words or portions of words uttered before and after. Consequently, context-dependent acoustic models are more accurate than context-independent acoustic models. However, the recognition of an utterance using context-dependent acoustic models requires more computation, and therefore more time, than the recognition of an utterance using context-independent acoustic models.

In speech recognition systems, it is also known to provide a fast acoustic match to quickly select a short list of candidate words, and then to provide a detailed acoustic match to more carefully evaluate each of the candidate words selected by the fast acoustic match. In order to quickly select candidate words, it is known to use context-independent acoustic models in the fast acoustic match. In order to more carefully evaluate each candidate word selected by the fast acoustic match, it is known to use context-dependent acoustic models in the detailed acoustic match.

SUMMARY OF THE INVENTION

It is an object of the invention to provide a speech coding apparatus and method for a fast acoustic match using the same context-dependent acoustic models used in a detailed acoustic match.

It is another object of the invention to provide a speech recognition apparatus and method having a fast acoustic match using the same context-dependent acoustic models used in a detailed acoustic match.

A speech coding apparatus according to the invention comprises means for measuring the value of at least one feature of an utterance over each of a series of successive time intervals to produce a series of feature vector signals representing the feature values. Storage means store a plurality of prototype vector signals. Each prototype vector signal has at least one parameter value. Comparison means compare the closeness of the feature value of a first feature vector signal to the parameter values of the prototype vector signals to obtain prototype match scores for the first feature vector signal and each prototype vector signal.

Storage means also store a plurality of speech transition models. Each speech transition model represents a speech transition from a vocabulary of speech transitions. Each speech transition has an identification value. At least one speech transition is represented by a plurality of different models. Each speech transition model has a plurality of model outputs. Each model output comprises a prototype match score for a prototype vector signal. Each speech transition model also has an output probability for each model output.

A model match score means generates a model match score for the first feature vector signal and each speech transition model. Each model match score comprises the output probability for at least one prototype match score for the first feature vector signal and a prototype vector signal.

A speech transition match score means generates a speech transition match score for the first feature vector signal and each speech transition. Each speech transition match score comprises the best model match score for the first feature vector signal and all speech transition models representing the speech transition.

Finally, output means outputs the identification value of each speech transition and the speech transition match score for the first feature vector signal and each speech transition as a coded utterance representation signal of the first feature vector signal.

The speech coding apparatus according to the invention may further include storage means for storing a plurality of speech unit models. Each speech unit model represents a speech unit comprising two or more speech transitions. Each speech unit model comprises two or more speech transition models. Each speech unit has an identification value.

A speech unit match score means generates a speech unit match score for the first feature vector signal and each speech unit. Each speech unit match score comprises the best speech transition match score for the first feature vector signal and all speech transitions in the speech unit.

In this aspect of the invention, the output means outputs the identification value of each speech unit and the speech unit match score for the first feature vector signal and each speech unit as a coded utterance representation signal of the first feature vector signal.

The comparison means may comprise, for example, ranking means for ranking the prototype vector signals in order of the estimated closeness of each prototype vector signal to the first feature vector signal to obtain a rank score for the first feature vector signal and each prototype vector signal. In this case, the prototype match score for the first feature vector signal and each prototype vector comprises the rank score for the first feature vector signal and each prototype vector signal.

Preferably, each speech transition model represents the corresponding speech transition in a unique context of prior and subsequent speech transitions. Each speech unit is preferably a phoneme, and each speech transition is preferably a portion of a phoneme.

A speech recognition apparatus according to the invention comprises means for measuring the value of at least one feature of an utterance over each of a series of successive time intervals to produce a series of feature vector signals representing the feature values. A storage means stores a plurality of prototype vector signals, and a comparison means compares the closeness of the feature value of each feature vector signal to the parameter values of the prototype vector signals to obtain prototype match scores for each feature vector signal and each prototype vector signal. A storage means stores a plurality of speech transition models, and a model match score means generates a model match score for each feature vector signal and each speech transition model. A speech transition match score means generates a speech transition match score for each feature vector signal and each speech transition from the model match scores. Storage means stores a plurality of speech unit models comprising two or more speech transition models. A speech unit match score means generates a speech unit match score for each feature vector signal and each speech unit from the speech transition match scores. The identification value of each speech unit and the speech unit match score of a feature vector signal and each speech unit is output as a coded utterance representation signal of the feature vector signal.

The speech recognition apparatus further comprises a storage means for storing probabilistic models for a plurality of words. Each word model comprises at least one speech unit model. Each word model has a starting state, an ending state, and a plurality of paths through the speech unit models from the starting state at least part of the way to the ending state. A word match score means generates a word match score for the series of feature vector signals and each of a plurality of words. Each word match score comprises a combination of the speech unit match scores for the series of feature vector signals and the speech units along at least one path through the series of speech unit models in the model of the word. Best candidate means identifies one: or more best candidate words having the best word match scores, and an output means outputs at least one best candidate word.

According to the invention, by selecting, as a match score for each speech transition, the best match score for all models of that speech transition, a speech coding and a speech recognition apparatus and method can use the same context-dependent acoustic models in a fast acoustic match as are used in a detailed acoustic match.

DESCRIPTION OF THE PREFERRED EMBODIMENTS

Figure 1:
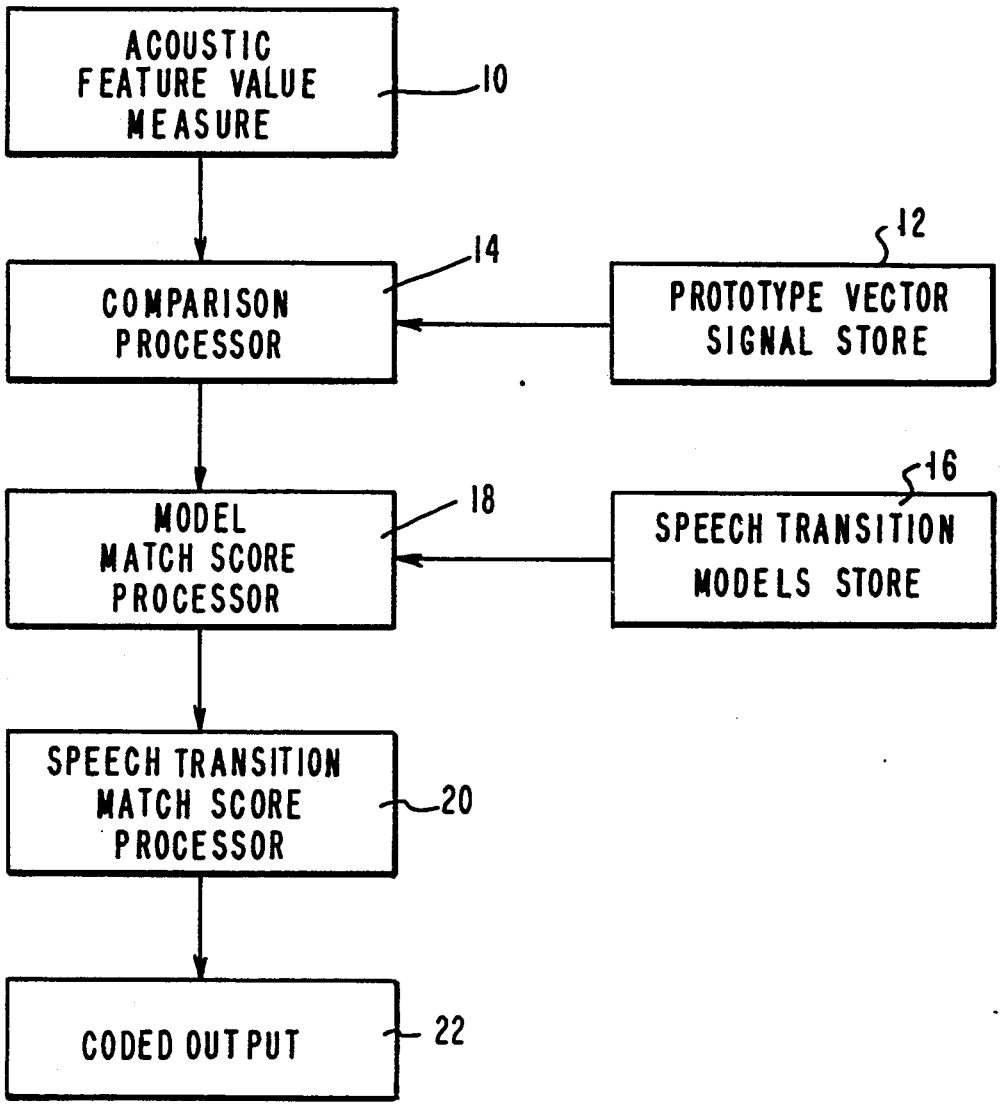
FIG. 1 is a block diagram of an example of a speech coding apparatus according to the invention.

FIG. 1 is a block diagram of an example of a speech coding apparatus according to the invention. The speech coding apparatus comprises an acoustic feature value measure 10 for measuring the value of at least one feature of an utterance over each of a series of successive time intervals to produce a series of feature vector signals representing the feature values. Table 1 illustrates a hypothetical series of one-dimension feature vector signals corresponding to time (t) intervals 1, 2, 3, 4, and 5, respectively.

TABLE 1

| Time (t) | Feature Vector FV(t) |
|---|---|
| 1 | 0.792 |
| 2 | 0.054 |

TABLE 1-continued

| Time (t) | Feature Vector FV(t) |
|---|---|
| 3 | 0.63 |
| 4 | 0.434 |
| 5 | 0.438 |

As described in more detail, below, the time intervals are preferably 20 millisecond duration samples taken every 10 milliseconds.

The speech coding apparatus further comprises a prototype vector signal store 12 for storing a plurality of prototype vector signals. Each prototype vector signal has at least one parameter value.

Table 2 shows a hypothetical example of nine prototype vector signals PV1*a*, PV1*b*, PV1*c*, PV2*a*, PV2*b*, PV3*a*, PV3*b*, PV3*c*, and PV3*d* having one parameter value each.

TABLE 2

| Prototype Vector Signal | Parameter Value | Closeness to FV(1) | Binary Prototype Match Score | Individual Rank Prototype Match Score | Group Rank Prototype Match Score |
|---|---|---|---|---|---|
| PV1a | 0.042 | 0.750 | 0 | 8 | 3 |
| PV1b | 0.483 | 0.309 | 0 | 3 | 3 |
| PV1c | 0.049 | 0.743 | 0 | 7 | 3 |
| PV2a | 0.769 | 0.023 | 1 | 1 | 1 |
| PV2b | 0.957 | 0.165 | 0 | 2 | 2 |
| PV3a | 0.433 | 0.359 | 0 | 4 | 3 |
| PV3b | 0.300 | 0.492 | 0 | 6 | 3 |
| PV3c | 0.408 | 0.384 | 0 | 5 | 3 |
| PV3d | 0.002 | 0.790 | 0 | 9 | 3 |

A comparison processor 14 compares the closeness of the feature value of a first feature vector signal to the parameter values of the prototype vector signals to obtain prototype match scores for the first feature vector signal and each prototype vector signal.

Table 2, above, illustrates a hypothetical example of the closeness of feature vector FV(1) of Table 1 to the parameter values of the prototype vector signals. As shown in this hypothetical example, prototype vector signal PV2*a* is the closest prototype vector signal to feature vector signal FV(1). If the prototype match score is defined to be "1" for the closest prototype vector signal, and if the prototype match score is "0" for all other prototype vector signals, then prototype vector signal PV2*a* is assigned a "binary" prototype match score of "1". All other prototype vector signals are assigned a "binary" prototype match score of "0".

Other prototype match scores may alternatively be used. For example, the comparison means may comprise ranking means for ranking the prototype vector signals in order of the estimated closeness of each prototype vector signal to the first feature vector signal to obtain a rank score for the first feature vector signal and each prototype vector signal. The prototype match score for the first feature vector signal and each prototype vector signal may then comprise the rank score for the first feature vector signal and each prototype vector signal.

In addition to "binary" prototype match scores, Table 2 shows examples of individual rank prototype match scores and group rank prototype match scores.

In the hypothetical example, the feature vector signals and the prototype vector signals are shown as having one dimension only, with only one parameter value for that dimension. In practice, however, the feature vector signals and prototype vector signals may have, for example, 50 dimensions. For each prototype vector signal, each dimension may have two parameter values. The two parameter values of each dimension may be, for example, a mean value and a standard deviation (or variance) value.

Still referring to FIG. 1, the speech coding apparatus further comprises a speech transition models store 16 for storing a plurality of speech transition models. Each speech transition model represents a speech transition from a vocabulary of speech transitions. Each speech transition has an identification value. At least one speech transition is represented by a plurality of different models. Each speech transition model has a plurality of model outputs. Each model output comprises a prototype match score for a prototype vector signal. Each speech transition model has an output probability for each model output.

Table 3 shows a hypothetical example of three speech transitions ST1, ST2, and ST3, each of which are represented by a plurality of different speech transition models. Speech transition ST1 is modelled by speech transition models TM1, TM3. Speech transition ST2 is modelled by speech transition model TM4, TM5, TM6, TM7, and TM8. Speech transition ST3 is modelled by speech transition models TM9 and TM10.

TABLE 3

| Speech Transition Identification Value | Speech Transition Model |
|---|---|
| ST1 | TM1 |
| ST1 | TM2 |
| ST1 | TM3 |
| ST2 | TM4 |
| ST2 | TM5 |
| ST2 | TM6 |
| ST2 | TM7 |
| ST2 | TM8 |
| ST3 | TM9 |
| ST3 | M10 |

Table 4 illustrates a hypothetical example of the speech transition models TM1 through TM10. Each speech transition model in this hypothetical example includes two model outputs having nonzero output probabilities. Each output comprises a prototype match score for a prototype vector signal. All prototype match scores for all other prototype vector signals have zero output probabilities.

TABLE 4

| Speech Transition Model | Model Output: Prototype Vector Signal | Model Output: Prototype Match Score | Output Probability | Model Output: Prototype Vector Signal | Model Output: Prototype Match Score | Output Probability |
|---|---|---|---|---|---|---|
| TM1 | PV3d | 1 | 0.511 | PV3c | 1 | 0.489 |
| TM2 | PV1b | 1 | 0.636 | PV1a | 1 | 0.364 |
| TM3 | PV2b | 1 | 0.682 | PV2a | 1 | 0.318 |
| TM4 | PV1a | 1 | 0.975 | PV1b | 1 | 0.025 |
| TM5 | PV1c | 1 | 0.899 | PV1b | 1 | 0.101 |
| TM6 | PV3d | 1 | 0.566 | PV3c | 1 | 0.434 |
| TM7 | PV2b | 1 | 0.848 | PV2a | 1 | 0.152 |
| TM8 | PV1b | 1 | 0.994 | PV1a | 1 | 0.006 |
| TM9 | PV3c | 1 | 0.178 | PV3a | 1 | 0.822 |
| TM10 | PV1b | 1 | 0.384 | PV1a | 1 | 0.616 |

The stored speech transition models may be, for example, Markov Models or other dynamic programming models. The parameters of the speech transition models may be estimated from a known uttered training text by, for example, smoothing parameters obtained by the forward-backward algorithm. (See, for example, F. Jelinek. "Continuous Speech Recognition by Statistical Methods." *Proceedings of the IEEE*, Vol. 64, No. 4, April 1976, pages 532–536.)

Preferably, each speech transition model represents the corresponding speech transition in a unique context of prior and subsequent speech transitions or phonemes. Context-dependent speech transition models can be produced, for example, by first constructing context-independent models either manually from models of phonemes, or automatically, for example by the method described in U.S. Pat. No. 4,759,068 entitled "Constructing Markov Models of Words from Multiple Utterances," or by any other known method of generating context-independent models.

Context-dependent models may then be produced by grouping utterances of a speech transition into context-dependent categories. The context can be, for example, manually selected, or automatically selected by tagging each feature vector signal corresponding to a speech transition with its context, and by grouping the feature vector signals according to their context to optimize a selected evaluation function.

Returning to FIG. 1, the speech coding apparatus further includes a model match score processor 18 for generating a model match score for the first feature vector signal and each speech transition model. Each model match score comprises the output probability for at least one prototype match score for the first feature vector signal and a prototype vector signal.

Table 5 illustrates a hypothetical example of model match scores for feature vector signal FV(1) and each speech transition model shown in Table 4, using the binary prototype match scores of Table 2. As shown in Table 4, the output probability of prototype vector signal **PV2*a* having a binary prototype match score of "1" is zero for all speech transition models except TM3 and TM7**.

TABLE 5

| Speech Transition Identification Value | Speech Transition Model | Model Match Score for FV(1) |
|---|---|---|
| ST1 | TM1 | 0 |
| ST1 | TM2 | 0 |
| ST1 | TM3 | 0.318 |
| ST2 | TM4 | 0 |
| ST2 | TM5 | 0 |
| ST2 | TM6 | 0 |

TABLE 5-continued

| Speech Transition Identification Value | Speech Transition Model | Model Match Score for FV(1) |
|---|---|---|
| ST2 | TM7 | 0.152 |
| ST2 | TM8 | 0 |
| ST3 | TM9 | 0 |
| ST3 | TM10 | 0 |

The speech coding apparatus further includes a speech transition match score processor 20. The speech transition match score processor 20 generates a speech transition match score for the first feature vector signal and each speech transition. Each speech transition match score comprises the best model match score for the first feature vector signal and all speech transition models representing the speech transition.

Table 6 illustrates a hypothetical example of speech transition match scores for feature vector signal FV(1) and each speech transition. As shown in Table 5, the best model match score for feature vector signal FV(1) and speech transition ST1 is the model match score of 0.318 for speech transition model TM3. The best model match score for feature vector signal FV(1) and speech transition ST2 is the model match score of 0.152 for speech transition model TM7. Similarly, the best model match score for feature vector signal FV(1) and speech transition ST3 is zero.

TABLE 6

| Speech Transition Identification Value | Speech Transition Match Score for FV(1) |
|---|---|
| ST1 | 0.318 |
| ST2 | 0.152 |
| ST3 | 0 |

Finally, the speech coding apparatus shown in FIG. 1 includes coded output means 22 for outputting the identification value of each speech transition and the speech transition match score for the first feature vector signal and each speech transition as a coded utterance representation signal of the first feature vector signal. Table 6 illustrates a hypothetical example of the coded output for feature vector signal FV(1).

Figure 2:
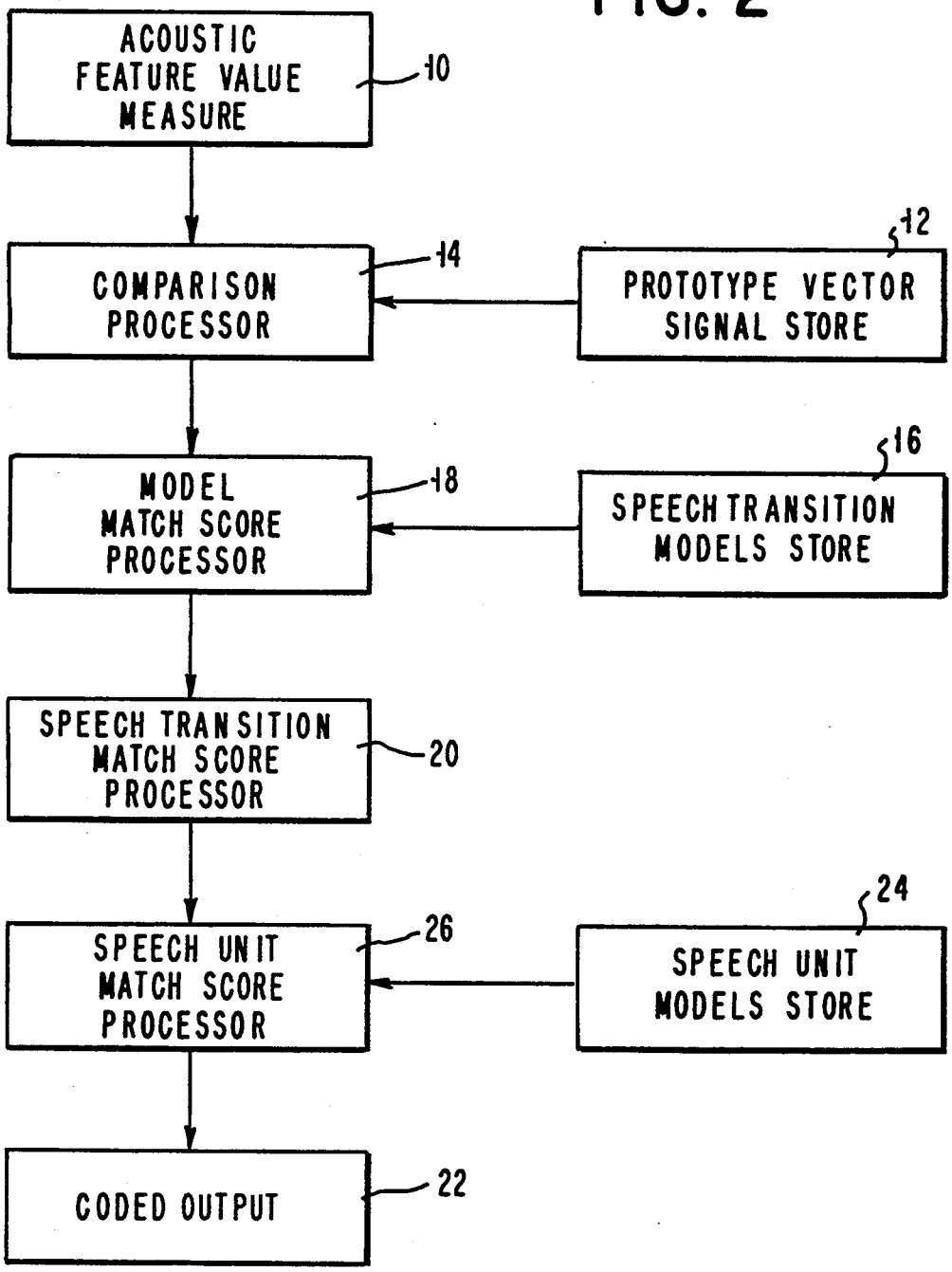
FIG. 2 is a block diagram of another example of a speech coding apparatus according to the invention.

FIG. 2 is a block diagram of another example of a speech coding apparatus according to the invention. In this example, the acoustic feature value measure 10, the prototype vector signal store 12, the comparison processor 14, the model match score processor 18, and the speech transition match score processor 20 are the same elements described with reference to FIG. 1. In this example, however, the speech coding apparatus further comprises a speech unit models store 24 for storing a plurality of speech unit models. Each speech unit model represents a speech unit comprising two or more speech transitions. Each speech unit model comprises two or more speech transition models. Each speech unit has an identification value. Preferably, each speech unit is a phoneme, and each speech transition is a portion of a phoneme.

Table 7 illustrates a hypothetical example of speech unit models SU1 and SU2 corresponding to speech units (phonemes) P1 and P2, respectively. Speech unit P1 comprises speech transitions ST1 and ST3. Speech unit P2 comprises speech transitions ST2 and ST3.

TABLE 7

| Speech Unit Identification Value | Speech Unit Model | Speech Transitions in Speech Units | | Speech Unit Match Score for FV(1) |
|---|---|---|---|---|
| P1 | SU1 | ST1 | ST3 | 0.318 |
| P2 | SU2 | ST2 | ST3 | 0.152 |

Still referring to FIG. 2, the speech coding apparatus .further comprises a speech unit match score processor 26. The speech unit match score processor 26 generates a speech unit match score for the first feature vector signal and each speech unit. Each speech unit match score comprises the best speech transition match score for the first feature vector signal and all speech transitions in the speech unit.

In this example of the speech coding apparatus according to the invention, the coded output means 22 outputs the identification value of each speech unit and the speech unit match score for the first feature vector signal and each speech unit as a coded utterance representation signal of the first feature vector signal.

As shown in the hypothetical example of Table 7, above, the coded utterance representation signal of feature vector signal FV(1) comprises the identification values for speech units P1 and P2, .and the speech unit match scores of 0.318 and 0.152, respectively.

Figure 3:
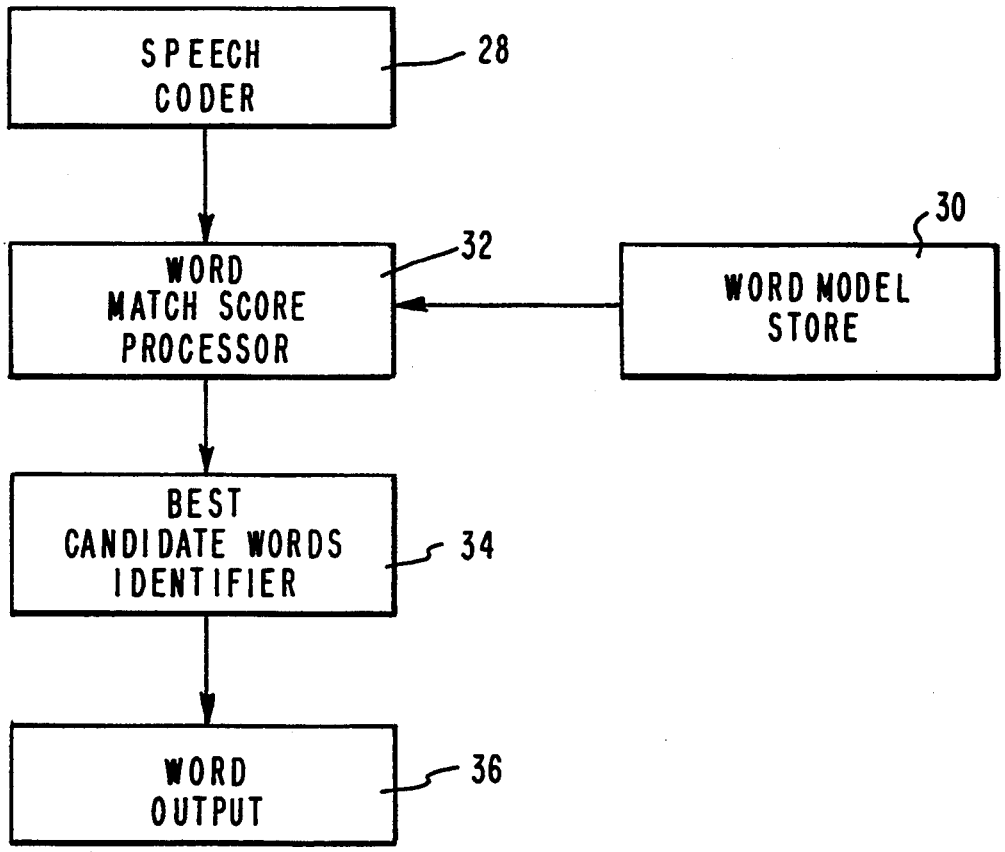
FIG. 3 is a block diagram of an example of a speech recognition apparatus according to the invention using a speech coding apparatus according to the invention.

FIG. 3 is a block diagram of an example of a speech recognition apparatus according to the invention using a speech coding apparatus according to the invention. The speech recognition apparatus comprises a speech coder 28 comprising all of the elements shown in FIG. 2. The speech recognition apparatus further includes a word model store 30 for storing probabilistic models for a plurality of words. Each word model comprises at least one speech unit model. Each word model has a starting state, an ending state, and a plurality of paths through the speech unit models from the starting state at least a part of the way to the ending state.

Figure 4:
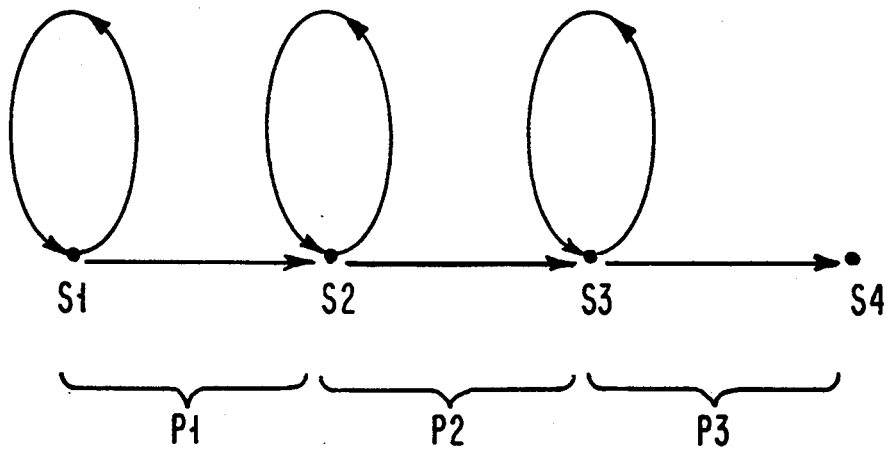
FIG. 4 schematically shows a hypothetical example of an acoustic model off a word or portion of a word.

FIG. 4 schematically shows a hypothetical example of an acoustic model of a word or a portion of a word. The hypothetical model shown in FIG. 4 has a starting state S1, an ending state S4, and a plurality of paths from the starting state S1 at least a part of the way to the ending state S4. The hypothetical model shown in FIG. 4 comprises models of speech units P1, P2, and P3.

Figure 5:
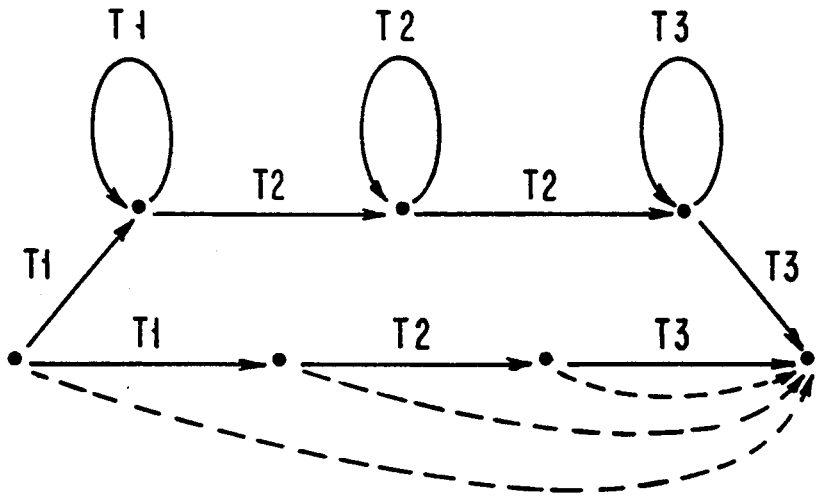
FIG. 5 schematically shows a hypothetical example of an acoustic model of a phoneme.

FIG. 5 schematically shows a hypothetical example of an acoustic model of a phoneme. In this example, the acoustic model comprises three occurrences of transition T1, four occurrences of transition T2, and three occurrences of transition T3. The transitions shown in dotted lines are null transitions. Each solid-line transition is modeled with a speech transition model having a model output comprising a prototype match score for a prototype vector signal. Each model output has an output probability. Each null transition is modeled with a transition model having no output.

Word models may be constructed either manually from phonetic models, or automatically from multiple utterances of each word in the manner described above.

Returning to FIG. 3, the speech recognition apparatus further includes a word match score processor 32. The word match score processor 32 generates a word match score for the series of feature vector signals and each of a plurality of words. Each word match score comprises a combination of the speech unit match scores for the series of feature vector signals and the speech units along at least one path through the series of speech unit models and the model of the word.

Table 8 illustrates a hypothetical example of speech unit match scores for feature vectors FV(1), FV(2), and FV(3) and speech units P1, P2, and P3.

TABLE 8

| Speech Unit | Speech Unit Match Score for FV(1) | Speech Unit Match Score for FV(2) | Speech Unit Match Score for FV(3) |
|---|---|---|---|
| P1 | 0.318 | 0.204 | 0.825 |
| P2 | 0.152 | 0.979 | 0.707 |
| P3 | 0.439 | 0.635 | 0.273 |

Table 9 illustrates a hypothetical example of transition probabilities for the transitions of the hypothetical acoustic models shown in FIG. 4.

TABLE 9

| Speech Unit | Transition | Transition Probability |
|---|---|---|
| P1 | S1->S1 | 0.2 |
| P1 | S1->S2 | 0.8 |
| P2 | S2->S2 | 0.3 |
| P2 | S2->S3 | 0.7 |
| P3 | S3->S3 | 0.2 |
| P3 | S3->S4 | 0.8 |

Table 10 illustrates a hypothetical example of the probabilities of feature vectors FV(1), FV(2), and FV(3), for each of the transitions of the acoustic model of FIG. 4.

TABLE 10

| Start State | Next State | Probability of FV(1) | Probability of FV(2) | Probability of FV(3) |
|---|---|---|---|---|
| S1 | S1 | 0.0636 | 0.0408 | 0.165 |
| S1 | S2 | 0.2544 | 0.1632 | 0.66 |
| S2 | S2 | 0.0456 | 0.2937 | 0.2121 |
| S2 | S3 | 0.1064 | 0.6853 | 0.4949 |
| S3 | S3 | 0.0878 | 0.127 | 0.0546 |
| S3 | S4 | 0.3512 | 0.508 | 0.2184 |

Figure 6:
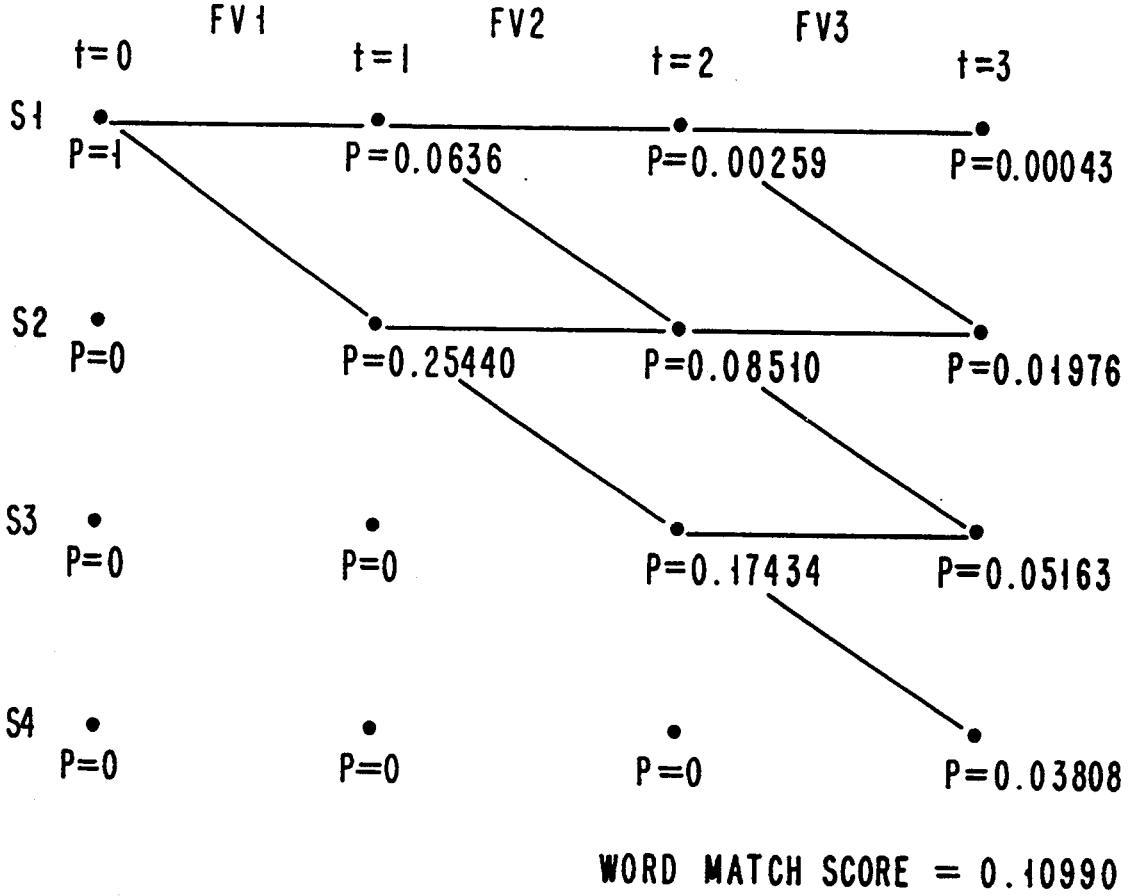
FIG. 6 schematically shows a hypothetical example of complete and partial paths through the acoustic model of FIG. 4.

FIG. 6 shows a hypothetical example of paths through the acoustic model of FIG. 4 and the generation of a word match score for the series of feature vector signals and this model using the hypothetical parameters of Tables 8, 9, and 10. In FIG. 6, the variable P is the probability of reaching each node (i.e. the probability of reaching each state at each time).

Returning to FIG. 3, the speech recognition apparatus further includes a best candidate words identifier 34 for identifying one or more best candidate words having the best word match scores. A word output 36 outputs at least one best candidate word.

Preferably, the speech coding apparatus amid the speech recognition apparatus according to the invention may be made by suitably programming either a special purpose or a general purpose digital computer system. More particularly, the comparison processor 14, the model match score processor 18, the speech transition match score processor 20, the speech unit match score processor 26, the word match score processor 32, and the best candidate words identifier 34 may be made by suitably programming either a special purpose or a general purpose digital processor. The prototype vector signal store 12, the speech transition models store 16, the speech unit models store 24, and the word model store 30 may be electronic computer memory. The word output 36 may be, for example, a video display, such as a cathode ray tube, a liquid crystal display, or a printer. Alternatively, the word output 36 may be an audio output device, such as a speech synthesizer having a loudspeaker or headphones.

Figure 7:
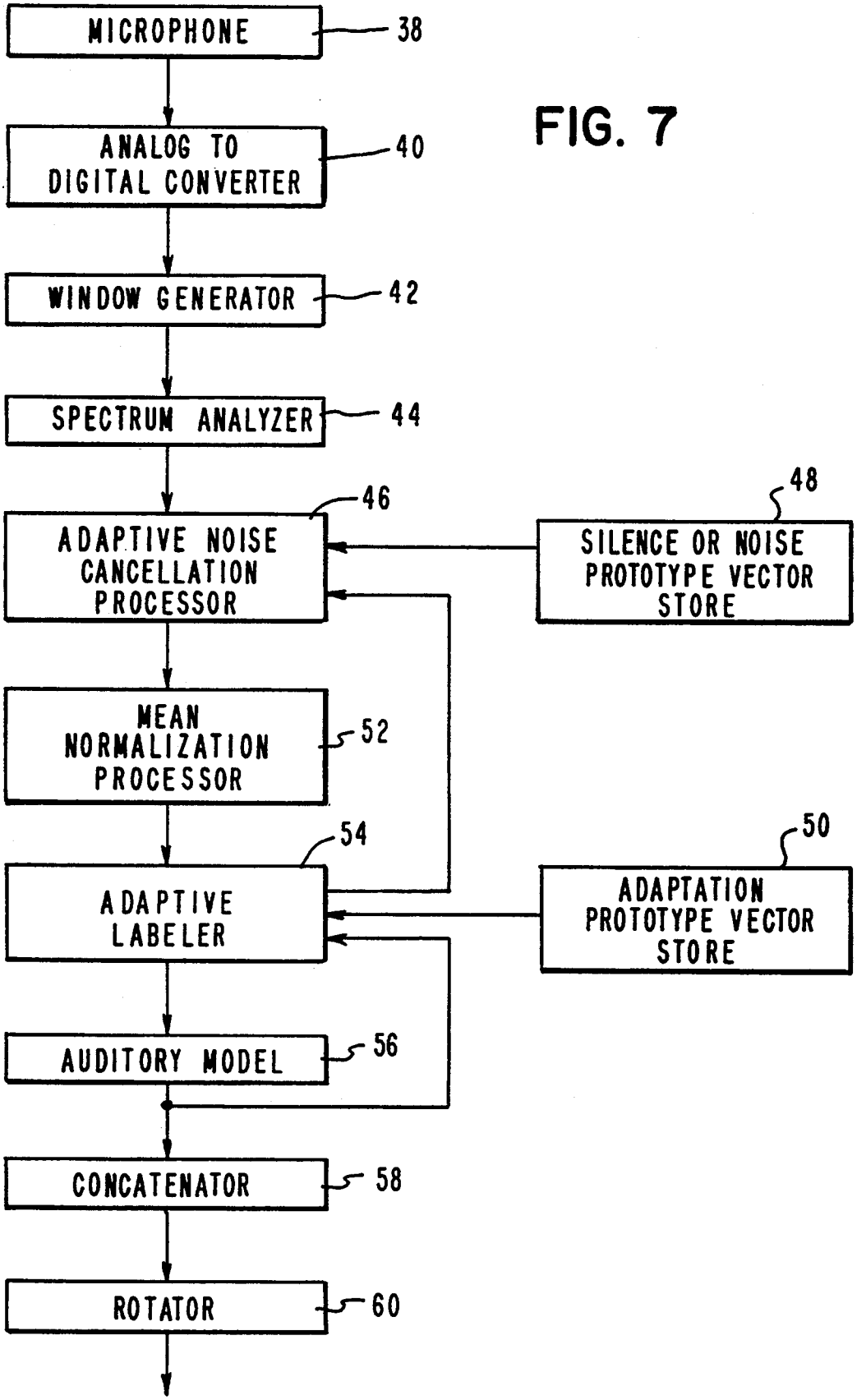
FIG. 7 block diagram of an example of an acoustic feature value measure used in the speech coding and speech recognition apparatus according to the present invention.

One example of an acoustic feature value measure is shown in FIG. 7. The measuring means includes a microphone 38 for generating an analog electrical signal corresponding to the utterance. The analog electrical signal from microphone 38 is converted to a digital electrical signal by analog to digital converter 40. For this purpose, the analog signal may be sampled, for example, at a rate of twenty kilohertz by the analog to digital converter 40.

A window generator 42 obtains, for example, a twenty millisecond duration sample of the digital signal from analog to digital converter 40 every ten milliseconds (one centisecond). Each twenty millisecond sample of the digital signal is analyzed by spectrum analyzer 44 in order to obtain the amplitude of the digital signal sample in each of, for example, twenty frequency bands. Preferably, spectrum analyzer 44 also generates a twenty-first dimension signal representing the total amplitude or total power of the twenty millisecond digital signal sample. The spectrum analyzer 44 may be, for example, a fast Fourier transform processor. Alternatively, it may be a bank of twenty band pass filters.

The twenty-one dimension vector signals produced by spectrum analyzer 44 may be adapted to remove background noise by an adaptive noise cancellation processor 46. Noise cancellation processor 46 subtracts a noise vector N(t) from the feature vector F(t) input into the noise cancellation processor to produce an output feature vector F'(t). The noise cancellation processor 46 adapts to changing noise levels by periodically updating the noise vector N(t) whenever the prior feature vector F(t−1) is identified as noise or silence. The noise vector N(t) is updated according to the formula $$N(t) = \frac{N(t-1) + k[F(t-1) - Fp(t-1)]}{(1+k)}, \quad [1]$$

where N(t) is the noise vector at time t, N(t−1) is the, noise vector at time (t−1), k is a fixed parameter of the adaptive noise cancellation model, F(t−1) is the feature vector input into the noise cancellation processor 46 at time (t−1) and which represents noise or silence, and Fp(t−1) is one silence or noise prototype vector, from store 48, closest to feature vector F(t−1).

The prior feature vector F(t−1) is recognized as noise or silence if either (a) the total energy of the vector is below a threshold, or (b) the closest prototype vector in adaptation prototype vector store 50 to the feature vector is a prototype representing noise or silence. For the purpose of the analysis of the total energy of the feature vector, the threshold may be, for example, the fifth percentile of all feature vectors (corresponding to both speech and silence) produced in the two seconds prior to the feature vector being evaluated.

After noise cancellation, the feature vector F'(t) is normalized to adjust for variations in the loudness of the input speech by short term mean normalization processor 52. Normalization processor 52 normalizes the twenty-one dimension feature vector F'(t) to produce a twenty dimension normalized feature vector X(t). The twenty-first dimension of the feature vector F'(t), representing the total amplitude or total power, is discarded. Each component i of the normalized feature vect X(t) at time t may, for example, be given by the equation $$X_i(t)=F'_i(t)-Z(t) \quad [2]$$

in the logarithmic domain, where F'(t) is the i-th component of the unnormalized vector at time t, and where Z(t) is a weighted mean of the components of F'(t) and Z(t−1) according to Equations 3 and 4:

$$Z(t)=0.9Z(t-1)+0.1M(t) \quad [3]$$

and where $$M(t)=\frac{1}{20}\sum_i F'_i(t) \quad [4]$$

The normalized twenty dimension feature vector X(t) may be further processed by an adaptive labeler 54 to adapt to variations in pronunciation of speech sounds. An adapted twenty dimension feature vector X'(t) is generated by subtracting a twenty dimension adaptation vector A(t) from the twenty dimension feature vector X(t) provided to the input of the adaptive labeler 54. The adaptation vector A(t) at time t may, for example, be given by the formula $$A(t)=\frac{A(t-1)+k[X(t-1)-Xp(t-1)]}{(1+k)}, \quad [5]$$

where k is a fixed parameter of the adaptive labeling model, X(t−1) is the normalized twenty dimension vector input to the adaptive labeler 54 at time (t−1), Xp(t−1) is the adaptation prototype vector (from adaptation prototype store 50) closest to the twenty dimension feature vector X(t−1) at time (t−1), and A(t−1) is the adaptation vector at time (t−1).

The twenty dimension adapted feature vector signal X'(t) from the adaptive labeler 54 is preferably provided to an auditory model 56. Auditory model 56 may, for example, provide a model of how the human auditory system perceives sound signals, An example of an auditory model is described in U.S. Patent 4,980,918 to Bahl et al entitled "Speech Recognition System with Efficient Storage and Rapid Assembly of Phonological Graphs".

Preferably, according to the present invention, for each frequency band i of the adapted feature vector signal X'(t) at time t, the auditory model 56 calculates a new parameter $E_i(t)$ according to Equations 6 and 7:

$$E_i(t)=K_1+K_2(X'_i(t))(N_i(t-1)) \quad [6]$$

where $$N_i(t)=K_3\times N_i(t-1)-E_i(t-1) \quad [7]$$

and where $K_1$, $K_2$, and $K_3$ are fixed parameters of the auditory model.

For each centisecond time interval, the output of the auditory model 56 is a modified twenty dimension feature vector signal. This feature vector is augmented by a twenty-first dimension having a value equal to the square root of the sum of the squares of the values of the other twenty dimensions.

For each centisecond time interval, a concatenator 58 preferably concatenates nine twenty-one dimension feature vectors representing the one current centisecond time interval, the four preceding centisecond time intervals, and the four following centisecond time intervals to form a single spliced vector of 189 dimensions. Each 189 dimension spliced vector is preferably multiplied in a rotator 60 by a rotation matrix to rotate the spliced vector and to reduce the spliced vector to fifty dimensions.

The rotation matrix used in rotator 60 may be obtained, for example, by classifying into M classes a set of 189 dimension spliced vectors obtained during a training session. The covariance matrix for all of the spliced vectors in the training set is multiplied by the inverse of the within-class covariance matrix for all of the spliced vectors in all M classes. The first fifty eigenvectors of the resulting matrix form the rotation matrix. (See, for example, "Vector Quantization Procedure For Speech Recognition Systems Using Discrete Parameter Phoneme-Based Markov Word Models" by L. R. Bahl, et al, *IBM Technical Disclosure Bulletin*, Volume 32, No. 7, December 1989, pages 320 and 321.)

Window generator 42, spectrum analyzer 44, adaptive noise cancellation processor 46, short term mean normalization on processor 52, adaptive labeler 54, auditory model 56, concatenator 58, and rotator 60, may be suitably programmed special purpose or general purpose digital signal processors. Prototype stores 48 and 50 may be electronic computer memory of the types discussed above.

The prototype vectors in prototype store 38 may be obtained, for example, by clustering feature vector signals from a training set into a plurality of clusters, and then calculating the mean and standard deviation for each cluster to form the parameter values of the prototype vector. When the training script comprises a series of word-segment models (forming a model of a series of words), and each word-segment model comprises a series of elementary models having specified locations in the word-segment models, the feature vector signals may be clustered by specifying that each cluster corresponds to a single elementary model in a single location in a single word-segment model. Such a method is described in more detail in U.S. patent application Ser. No. 730,714, filed on Jul. 16, 1991, entitled "Fast Algorithm for Deriving Acoustic Prototypes for Automatic Speech Recognition."

Alternatively, all acoustic feature vectors generated by the utterance of a training text and which correspond to a given elementary model may be clustered by K-means Euclidean clustering or K-means Gaussian clustering, or both. Such a method is described, for example, in U.S. patent application Ser. No. 673,810, filed on Mar. 22, 1991 entitled "Speaker-Independent Label Coding Apparatus".

We claim:

1. A speech coding apparatus comprising:

means for measuring the value of at least one feature of an utterance over each of a series of successive time intervals to produce a series of feature vector signals representing the feature values;

means for storing a plurality of prototype vector signals, each prototype vector signal having at least one parameter value;

means for comparing the closeness of the feature value of a first feature vector signal to the parameter values of the prototype vector signals to obtain prototype match scores for the first feature vector signal and each prototype vector signal;

means for storing a plurality of speech transition models, each speech transition model representing a speech transition from a vocabulary of speech transitions, each speech transition having an identification value, at least one speech transition being represented by a plurality of different speech transition models, each speech transition model having a plurality of speech transition model outputs, each speech transitions model output comprising a prototype match score for a prototype vector signal, each speech transition model having an output probability for each model output;

means for generating a model match score for the first feature vector signal and each speech transition model, each model match score comprising the output probability for at least one prototype match score for the first feature vector signal and a prototype vector signal;

means for generating a speech transition match score for the first feature vector signal and each speech transition, each speech transition match score comprising the best model match score for the first feature vector signal and all speech transition models representing the speech transition and means for outputting the identification value of each speech transition and the speech transition match score for the first feature vector signal and each speech transition as a coded utterance representation signal of the first feature vector signal.

2. An apparatus as claimed in claim 1, further comprising:

means for storing a plurality of speech unit models, each speech unit model representing a speech unit comprising two or more speech transitions, each speech unit model comprising two or more speech transition models, each speech unit having an identification value; and means for generating a speech unit match score for the first feature vector signal and each speech unit, each speech unit match score comprising the best speech transition match score for the first feature vector signal and all speech transitions in the speech unit; and characterized in that the output means outputs the identification value of each speech unit and the speech unit match score for the first feature vector signal and each speech unit as a coded utterance representation signal of the first feature vector signal.

3. An apparatus as claimed in claim 2, characterized in that:

the comparison means comprises ranking means for ranking the prototype vector signals in order of the estimated closeness of each prototype vector signal to the first feature vector signal to obtain a rank score for the first feature vector signal and each prototype vector signal; and the prototype match score for the first feature vector signal and each prototype vector signal comprises the rank score for the first feature vector signal and each prototype vector signal.

4. An apparatus as claimed in claim 3, characterized in that each speech transition model represents the corresponding speech transition in a unique context of prior and subsequent speech transitions.

5. An apparatus as claimed in claim 4, characterize in that:

each speech unit is a phoneme; and each speech transition is a portion of a phoneme.

6. An apparatus as claimed in claim 5, characterized in that the measuring means comprises a microphone.

7. An apparatus as claimed in claim 6, further comprising means for storing the coded utterance representation signal of the feature vector signal.

8. An apparatus as claimed in claim 7, characterized in that the means for storing prototype vector signals comprises electronic read/write memory.

9. A speech coding method comprising:

measuring the value of at least one feature of an utterance over each of a series of successive time intervals to produce a series of feature vector signals representing the feature values;

storing a plurality of prototype vector signals, each prototype vector signal having at least one parameter value;

comparing the closeness of the feature value of a first feature vector signal to the parameter values of the prototype vector signals to obtain prototype match scores for the first feature vector signal and each prototype vector signal;

storing a plurality of speech transition models, each speech transition model representing a speech transition from a vocabulary of speech transitions, each speech transition having an identification value, at least one speech transition being represented by a plurality of different speech transition models, each speech transition model having a plurality of speech transition model outputs, each speech transition model output comprising a prototype match score for a prototype vector signal, each speech transition model having an output probability for each speech transition model output;

generating a model match score for the first feature vector signal and each speech transition model, each model match score comprising the output probability for at least one prototype match score for the first feature vector signal and a prototype vector signal;

generating a speech transition match score for the first feature vector signal and each speech transition, each speech transition match score comprising the best model match score for the first feature vector signal and all speech transition models representing the speech transition; and outputting the identification value of each speech transition and the speech transition match score For the first feature vector signal and each speech transition as a coded utterance representation signal of the first feature vector signal.

10. A method as claimed in claim 9, further comprising the steps of:

storing a plurality of speech unit models, each speech unit model representing a speech unit comprising two or more speech transitions, each speech unit model comprising two or more speech transition models, each speech unit having an identification value; and generating a speech unit match score for the first feature vector signal and each speech unit, each speech unit match score comprising the best speech transition match score for the first feature vector signal and all speech transitions in the speech unit; and characterized in that the step of outputting outputs the identification value of each speech unit and the speech unit match score for the first feature vector signal and each speech unit as a coded utterance representation signal of the first feature vector signal.

11. A method as claimed in claim 10, characterized in that:

the step of comparing comprises ranking the prototype vector signals in order of the estimated closeness of each prototype vector signal to the first feature vector signal to obtain a rank score for the first feature vector signal and each prototype vector signal; and the prototype match score for the first feature vector signal and each prototype vector signal comprises the rank score for the first feature vector signal and each prototype vector signal.

12. A method as claimed in claim 11, characterized in that: each speech transition model represents the corresponding speech transition in a unique context of prior and subsequent speech transitions.

13. A method as claimed in claim 12, characterized in that:

each speech unit is a phoneme; and each speech transition is a portion of a phoneme.

14. A method as claimed in claim 12, further comprising the step of storing the coded utterance representation signal of the feature vector signal.

15. A speech recognition apparatus comprising:

means for measuring the value of at least one feature of an utterance over each of a series of successive time intervals to produce a series of feature vector signals representing the feature values;

means for storing a plurality of prototype vector signals, each prototype vector signal having at least one parameter value;

means for comparing the closeness of the feature value of each feature vector signal to the parameter values of the prototype vector signals to obtain prototype match scores for each feature vector signal and each prototype vector signal;

means for storing a plurality of speech transition models, each speech transition model representing a speech transition from a vocabulary of speech transitions, each speech transition having an identification value, at least one speech transition being represented by a plurality of different speech transition model, each speech transition model having a plurality of speech transitions model outputs, each speech transition model output comprising a prototype match score for a prototype vector signal, each speech transition model having an output probability for each model output;

means for generating a model match score for each feature vector signal and each speech transition model, the model match score for a feature vector signal comprising the output probability for at least one prototype match score for the feature vector signal and a prototype vector signal;

means for generating a speech transition match score for each feature vector signal and each speech transition, the speech transition match score for a feature vector signal. comprising the best model match score for the feature vector signal and all speech transition models representing the speech transition;

means for storing a plurality of speech unit models, each speech unit model representing a speech unit comprising two or more speech transitions, each speech unit model comprising two or more speech transition models, each speech unit having an identification value;

means for generating a speech unit match score for each feature vector signal and each speech unit, the speech unit match score for a feature vector signal comprising the best speech transition match score for the feature vector signal and all speech transitions in the speech unit;

means for outputting the identification value of each speech unit and the speech unit match score of a feature vector signal and each speech unit as a coded utterance representation signal of the feature vector signal;

means for storing probabilistic models for a plurality of words, each word model comprising at least one speech unit model, each word model having a starting state, an ending state, and a plurality of paths through the speech unit models from the starting state at least part of the way to the ending state;

means for generating a word match score for the series of feature vector signals and each of a plurality of words, each word match score comprising a combination of the speech unit match scores for the series of feature vector signals and the speech units along at least one path through the series of speech unit models in the model of the word;

means for identifying one or more best candidate words having the best word match scores; and means for outputting at least one best candidate word.

16. An apparatus as claimed in claim 15, characterized in that:

the comparison means comprises ranking means for ranking the prototype vector signals in order of the estimated closeness of each prototype vector signal to each feature vector signal to obtain a rank score for each feature vector signal and each prototype vector signal; and the prototype match score for a feature vector signal and each prototype vector signal comprises the rank score for the feature vector signal and the prototype vector signal.

17. An apparatus as claimed in claim 16, characterized in that each speech unit model represents the corresponding speech unit in a unique context of prior and subsequent speech units.

18. An apparatus as claimed in claim 17, characterized in that each speech unit is a phoneme, and each speech transition is a portion of a phoneme.

19. An apparatus as claimed in claim 18, characterized in that the measuring means comprises a microphone.

20. An apparatus as claimed in claim 19, further comprising means for storing the coded utterance representation signal of the feature vector signal.

21. An apparatus as claimed in claim 18, characterized in that the means for storing prototype vector signals comprises electronic read/write memory.

22. An apparatus as claimed in claim 18, characterized in that the word output means comprises a display.

23. An apparatus as claimed in claim 18, characterized in that the word output means comprises a printer.

24. An apparatus as claimed in claim 18, characterized in that the word output means comprises a speech synthesizer.

25. An apparatus as claimed in claim 18, characterized in that the word output means comprises a loudspeaker.

26. A speech recognition method comprising:

measuring the value of at least one feature of an utterance over each of a series of successive time intervals to produce a series of feature vector signals representing the feature values;

storing a plurality of prototype vector signals, each prototype vector signal having at least one parameter value;

comparing the closeness of the feature value of each feature vector signal to the parameter values of the prototype vector signals to obtain prototype match scores for each feature vector signal and each prototype vector signal;

storing a plurality of speech transition models, each speech transition model representing a speech transition from a vocabulary of speech transitions, each speech transition having an identification value, at least one speech transition being represented by a plurality of different speech transition models, each speech transition model having a plurality of speech transition model outputs, each speech transition model output comprising a prototype match score for a prototype vector signal, each speech transition model having an output probability for each speech transition model output;

generating a model match score for each feature vector signal and each speech transition model, the model match score for a feature vector signal comprising the output probability for at least one prototype match score for the feature vector signal and a prototype vector signal;

generating a speech transition match score for each feature vector signal and each speech transition, the speech transition match score for a feature vector signal comprising the best model match score for the feature vector signal and all speech transition models representing the speech transition;

storing a plurality of speech unit models, each speech unit model representing a speech unit comprising two or more speech transitions, each speech unit model comprising two or more speech transition models, each speech unit having an identification value;

generating a speech unit match score for each feature vector signal and each speech unit, the speech unit match score for a feature vector signal comprising the best speech transition match score for the feature vector signal and all speech transitions in the speech unit;

outputting the identification value of each speech unit and the speech unit match score of a feature vector signal and each speech unit as a coded utterance representation signal of the feature vector signal;

storing probabilistic models for a plurality of words, each word model comprising at least one speech unit model, each word model having a starting state, an ending state, and a plurality of paths through the speech unit models from the starting state at least part of the way to the ending state;

generating a word match score for the series of feature vector signals and each of a plurality of words, each word match score comprising a combination of the speech unit match scores for the series of feature vector signals and the speech units along at least one path through the series of speech unit models in the model of the word;

identifying one or more best candidate words having the best word match scores; and outputting at least one best candidate word.

27. A method as claimed in claim 26, characterized in that:

the step of comparing comprises ranking the prototype vector signals in order of the estimated closeness of each prototype vector signal to each feature vector signal to obtain a rank score for each feature vector signal and each prototype vector signal; and the prototype match score for a feature vector signal and each prototype vector signal comprises the rank score for the feature vector signal and the prototype vector signal.

28. A method as claimed in claim 27, characterized in that each speech unit model represents the corresponding speech unit in a unique context of prior and subsequent speech units.

29. A method as claimed in claim 28, characterized in that each speech unit is a phoneme, and each speech transition is a portion of a phoneme.

30. A method as claimed in claim 29, characterized in that the step of outputting comprises displaying at least one best candidate word.

31. A speech coding apparatus comprising:

means for measuring the value of at least one feature of an utterance over each of a series of successive time intervals to produce a series of feature vector signals representing the feature values;

means for storing a plurality of prototype vector signals, each prototype vector signal having at least one parameter value;

means for comparing the closeness of the feature value of a first feature vector signal to the parameter values of the prototype vector signals to obtain prototype match scores for the first feature vector signal and each prototype vector signal;

means for storing a plurality of speech transition models, each speech transition model representing a speech transition from a vocabulary of speech transitions, each speech transition having an identification value, at least one speech transition being represented by a plurality of different speech transition models, each speech transition model having a plurality of speech transition model outputs, each speech transition model output comprising a prototype match score for a prototype vector signal, each speech transition model having an output probability for each speech transition model output;

means for generating a model match score for the first feature vector signal and each speech transition model, each model match score comprising the output probability for at least one prototype match score for the first feature vector signal and a prototype vector signal;

means for storing a plurality of speech unit models, each speech unit model representing a speech unit comprising two or more speech transitions, each speech unit model comprising two or more speech transition models, each speech unit having an identification value;

means for generating a speech unit match score for the first feature vector signal and each speech unit, each speech unit match score comprising the best model match score for the first feature vector signal and all speech transition models representing speech transitions in the speech unit; and means for outputting the identification value of each speech unit and the speech unit match score for the first feature vector signal and each speech unit as a coded utterance representation signal of the first feature vector signal.

* * * * *